US007490954B2

(12) United States Patent
Mayer et al.

(10) Patent No.: US 7,490,954 B2
(45) Date of Patent: Feb. 17, 2009

(54) LED TRAFFIC SIGNAL

(75) Inventors: Mark J. Mayer, Sagamore Hills, OH (US); Eden Dubuc, Saint-Michel (CA); Patrick Martineau, Ile-Perrot (CA)

(73) Assignee: Lumination LLC, Valley View, OH (US)

( * ) Notice: Subject to any disclaimer, the term of this patent is extended or adjusted under 35 U.S.C. 154(b) by 0 days.

(21) Appl. No.: 11/193,572

(22) Filed: Jul. 29, 2005

(65) Prior Publication Data

US 2006/0039150 A1 Feb. 23, 2006

Related U.S. Application Data

(60) Provisional application No. 60/642,170, filed on Jan. 7, 2005, now abandoned, provisional application No. 60/592,992, filed on Jul. 30, 2004.

(51) Int. Cl.
*F21V 1/00* (2006.01)
*F21V 11/00* (2006.01)

(52) U.S. Cl. ..... 362/235; 362/249; 362/326; 362/545; 362/800

(58) Field of Classification Search ..... 362/235, 362/249, 326, 800
See application file for complete search history.

(56) References Cited

U.S. PATENT DOCUMENTS

| | | | | |
|---|---|---|---|---|
| 5,128,848 | A * | 7/1992 | Enders et al. | 362/268 |
| 5,490,049 | A * | 2/1996 | Montalan et al. | 362/240 |
| 6,352,359 | B1 * | 3/2002 | Shie et al. | 362/522 |
| 6,799,864 | B2 * | 10/2004 | Bohler et al. | 362/236 |
| 2002/0034081 | A1 * | 3/2002 | Serizawa | 362/540 |

* cited by examiner

*Primary Examiner*—Sandra O'Shea
*Assistant Examiner*—Jason Moon Han
(74) *Attorney, Agent, or Firm*—Fay Sharpe LLP

(57) ABSTRACT

A LED signal includes a housing and a cover. At least one LED is arranged on a PCB and mounted within the housing. A collimator that collimates light energy emitted by the at least one LED is positioned adjacent to the at least one LED. A diffuser is positioned adjacent to the collimator and spreads collimated light transmitted through the collimator. The PCB, the collimator, and the diffuser are disposed between the cover and the housing, and the cover provides a protective barrier between environmental conditions and the collimator and diffuser.

19 Claims, 4 Drawing Sheets

LED TRAFFIC SIGNAL

CROSS-REFERENCE TO RELATED PATENTS AND APPLICATIONS

This application claims the benefit of U.S. Provisional Patent Application Ser. No. 60/592,992 filed on Jul. 30, 2004 and entitled "LED Traffic Signal" and U.S. Provisional Patent Application Ser. No. 60/642,170 filed on Jan. 7, 2005 now abandoned and entitled "LED Traffic Signal," the entireties of which are incorporated herein by reference.

BACKGROUND OF THE INVENTION

1. Field of the Invention

The present invention relates to signals, in particular, Light Emitting Diode (LED) traffic signals. More specifically, the present invention relates to a LED traffic signal having a protective cover that protects collimating and diffusing optical elements from environmental conditions.

2. Description of Related Art

LED signals such as LED traffic signals, present numerous advantages over incandescent lamp traffic signals. Use of LEDs provides a power consumption savings and extremely long life compared to incandescent light sources. The long life span of the LED signals leads to improved reliability and lower maintenance costs. Typical LED signals use multiple LEDs in an array to replicate the light output of the incandescent lamp. Multiple LEDs can create a display aspect within which the individual points of light from each LED are discernable. Thus, the lit appearance of the signal is visually displeasing. If one or more LED burns out, a void is left in the lit appearance of the lens. Further, if the LEDs are not closely matched in intensity and color the resultant lit appearance is non-homogenous. Each generation of LEDs is brighter, requiring fewer LEDs to meet the intensity specification. While using fewer LEDs reduces the cost of the signal, it also increases the potential for viewing the LEDs as individual point sources and for having undesirable shadows.

There is an unmet need for an improved LED signal that overcomes the aforementioned, as well as other, deficiencies with conventional LED signals.

SUMMARY OF THE INVENTION

In one aspect of the invention, a LED signal having a protective cover is provided. The LED signal includes at least one LED arranged on a PCB. An optical element that collimates light energy emitted from the at least one LED is positioned adjacent to the at least one LED. A diffusing element is positioned adjacent to the optical element and spreads collimated light transmitted through the optical element. The PCB, the optical element, and the diffusing element are disposed between the cover and a housing of the LED signal, and the cover provides a protective barrier between environmental conditions and the optical and diffusing elements.

BRIEF DESCRIPTION OF THE FIGURES

The drawings are only for purposes of illustrating embodiments and are not to be construed as limiting the claims.

DETAILED DESCRIPTION OF THE INVENTION

Figure 1:
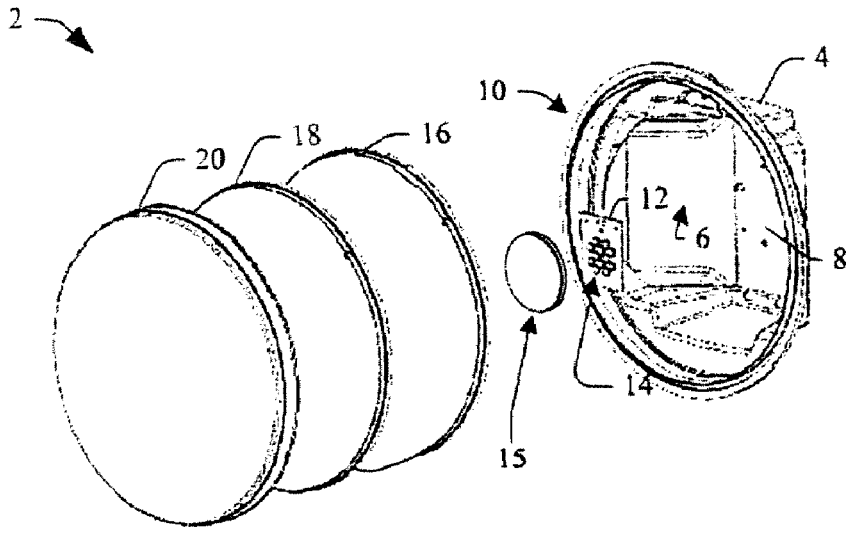
FIG. 1 illustrates an exploded view of a Light Emitting Diode (LED) signal.

FIG. 1 illustrates an exploded view of Light Emitting Diode (LED) signal 2. The LED signal 2 includes a housing 4 having an inner volume 6 and at least one surface 8 facing an opening 10 of the housing 4. A circuit board ("PCB") 12 is attached to the at least one surface 8. The circuit board 12 can be a metal core PCB or other type of PCB. Various techniques can be used to attach the circuit board 12 to the at least one surface 8. For example, the circuit board 12 can be attached through one or more rivets, screws, adhesives, snaps, tape, wires, other circuit boards, etc. Alternatively, the circuit board 12 can be integrated within the surface 8 of the housing 4. In another alternative, the circuit board 12 sits in a predefined position on the surface 8 and is held in place through various other components within the housing 4. For instance, the circuit board 12 can be held in place by one or more mounting brackets, heat sinks, a control module, a power supply, etc. A suitable heat sink includes a heat sink with fins.

The circuit board 12 includes one or more LEDs 14, which are coupled to the circuit board 12 via through-hole (e.g., soldered and wire wrapped) and/or surface mount (e.g., short pins, flat contacts, matrix of balls (BGAs), etc.) technology.

The circuit board 12 is positioned on the surface 8 such that the LEDs 14 emit light energy through the opening 10. Essentially any number of LEDs 14 can be coupled to the circuit board 12. In addition, one or more of the LEDs 14 can be a similar and/or different color. Different LED manufacturers provide LEDs 14 with distinctive light patterns.

An optional lens 15 can be placed over each LED 14 to change the light pattern so that different LEDs can be used without adversely affecting efficiency and/or the uniformity of the signal and/or light patterns can be changed based on the application. To facilitate controlling the light from the LEDs, an injection molded optical element typically is used.

A first optical element 16 is positioned adjacent to the opening 10 of the housing 4. The optical element 16 includes a collecting and/or collimating surface that collects and/or collimates light energy emitted by the LEDs 14. A second optical element 18 is positioned adjacent to the first optical element 16, on a side of the first optical element 16 opposite the LEDs 14. The second element 18 includes a spreading or diffusing surface, which suitably spreads light energy transmitted through the first optical element 16. A third optical element 20 is positioned adjacent to the second optical element 18, on a side of the second optical element 18 opposite the first optical element 16. It connects to the housing 4 and secures the first and second optical elements 16 and 18 in place. A sealing technique such as an O-ring can be used to facilitate attaching the third optical element 20 to the housing 4 and sealing the attachment region. Typically, the third optical element 20 includes a clear, neutral outer cover.

However, it can additionally or alternatively include at lease one of a tinted or colored surface, a textured surface, and/or optics such as a filter.

It is to be appreciated that one or more of the first, second, and third optical elements can have substantially planar surfaces.

The third optical element 20 also shields the first and second optical elements 16 and 18, the LEDs 14, the circuit board 12 or other components residing between the third optical element 20 and the surface 8 of the housing 4 from the environment. Thus, when an object (e.g., a stone, a tree branch, a bird, etc.) contacts the optical portion of the signal 2, the object is shielded from the first and second optical elements 16 and 18 by the third optical element 20. If the object damages the third optical element 20, it can be replaced at a cost relatively lower than replacing the first and/or second optical elements 16 and 18, for example. In addition, in many instances a damaged third optical element still provides adequate protection from the environment, does not substantially degrade light output from the signal 2, and does not have to be replaced.

The third optical element 20 can also protect the first and second optical elements 16 and 18, the LEDs 14, the circuit board 12 or other components from any of rain, snow, the wind, or the sun.

Conventional traffic signals typically do not employ an outer neutral cover. Instead, the diffusing and/or collimating optical element is exposed to the environment and susceptible to damage from the environment. As noted above, replacing diffusing and/or collimating optical elements is relatively more costly than replacing a neutral cover protecting such optical elements. In addition, damaging the diffusing and/or collimating optical elements may render the light output inadequate for its application. For instance, the light output may no longer be visible to the intended viewer. Thus, the novel invention described herein provides advantages over and/or overcomes deficiencies with conventional traffic signals.

It is to be appreciated the signal 2 can be adapted to retrofit into an existing traffic light and/or incorporated into a new traffic light. To allow an easy retrofit without requiring significant changes to the preexisting AC power distribution and logic circuits, the LED signal assemblies can incorporate a power supply (not shown) to drive the LEDs at a lower, controlled, direct current power level.

Figure 2:
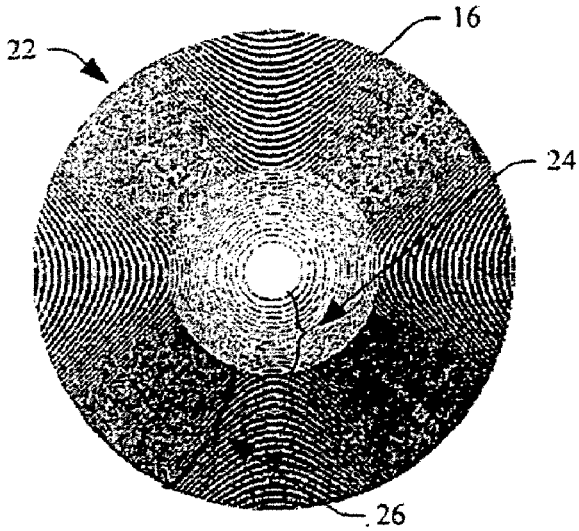
FIG. 2 illustrates an exemplary collimating optical element of a LED signal.

FIG. 2 illustrates a non-limiting example of a suitable first optical element 16. As depicted, a surface of the first optical element 16 can include one or more Fresnel rings 22. The light energy from the LEDs 14 is collimated by the one or more Fresnel rings 22.

In one instance, the one or more Fresnel rings 22 include one or more dioptric rings 24 and/or one or more catadioptric rings 26 that collimate the light.

Figure 3:
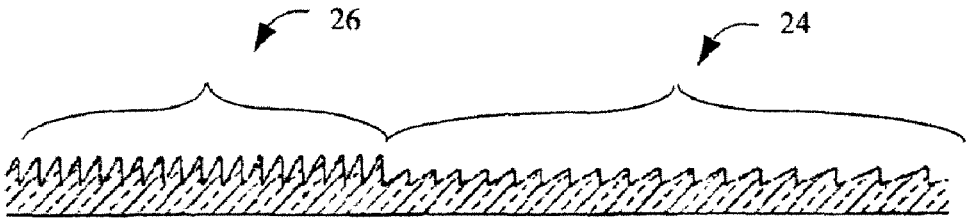
FIG. 3 illustrates a cross sectional view showing both dioptic rings and catadioptric rings of a collimating optical element.

FIG. 3 illustrates a cross section view of the first optical element 16, showing both dioptric rings 24 and catadioptric rings 26. Returning to FIG. 2, the dioptric rings 24 generally refract light, and catadioptric rings 26 generally refract and substantially internally reflect the rays of light.

Typically, the dioptric rings 24 are employed relatively nearer to the center of the first optical element 16, as depicted in FIG. 2, and the catadioptric rings 26 are employed farther from the center of the first optical element 16, as depicted in FIG. 2. After the light passes through the first optical element 16, the light is substantially collimated.

Figure 4:
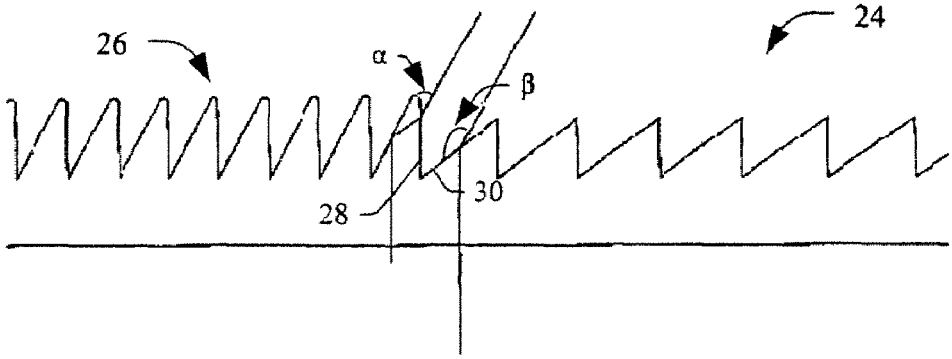
FIG. 4 illustrates exemplary light collection angles of dioptric and catadioptric rings of a collimating optical element.

An optical element characteristic that can affect the efficiency of the first optical element 16 includes, but is not limited to, light collection angles of the optical faces of each of the dioptric rings 24 and catadioptric rings 26. FIG. 4 illustrates the light collection angle "α" of the optical face 28 of a catadioptric ring and the light collection angle "β" of the optical face 30 of a dioptric ring. As depicted, the angle of the catadioptric rings 26 typically is more acute than the angle of the dioptric rings 24. In addition, with the dioptric rings 24, the radii represent a much larger percentage of the collection angle than on the catadioptric rings 26. Typically, the dioptric rings 24 and the catadioptric rings 26 do not have a constant height. In addition, the catadioptric rings 26 typically are taller than the dioptric rings 24, and the rings 24 and 26 typically are as tall as practically possible to minimize the number of fillet radii. A typical height ratio of the dioptric rings height to catadioptric ring height is about 1.5:1 to about 2:1.

Another optical element characteristic that affects the efficiency of the first optical element 16 is a transition region between the dioptric rings 24 and the catadioptric rings 26. For a given focal length, lens diameter, inner and/or outer fillet radii, and optic height, this transition region typically is determined based on one or more assumptions, including that the light source is a point source. However, the LEDs 14 are not a point source, but approximate a point source and, thus, the transition region typically is additionally tuned. The light energy that falls within the prescribed optical pattern is measured and compared against optical designs that have slightly larger and slightly smaller transition regions to tune the transition region.

Typical transition regions reside in a range from about F=0.5 to about F=1.5 (e.g., typically about 0.84), where F is a ratio of focal length to a diameter of the dioptric rings 24.

Figure 5:
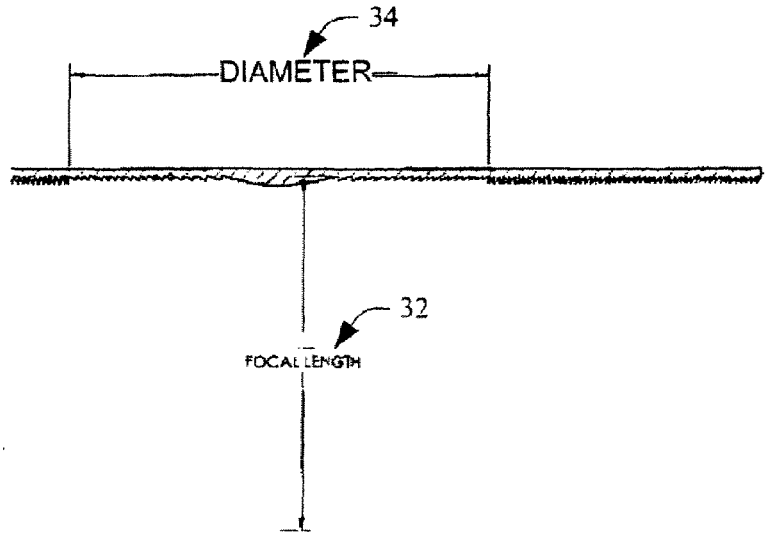
FIG. 5 illustrates various characteristics associated with dioptic rings of a collimating optical element.

FIG. 5 illustrates suitable locations for obtaining a focal length 32 and a diameter 34 for computing F.

Figure 6:
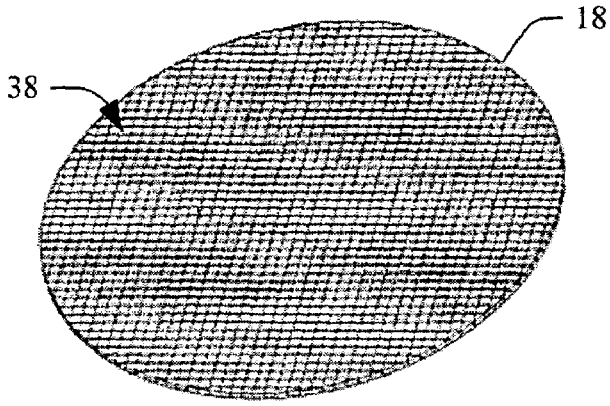
FIG. 6 illustrates an exemplary spreading or diffusing optical element.
Figure 7:
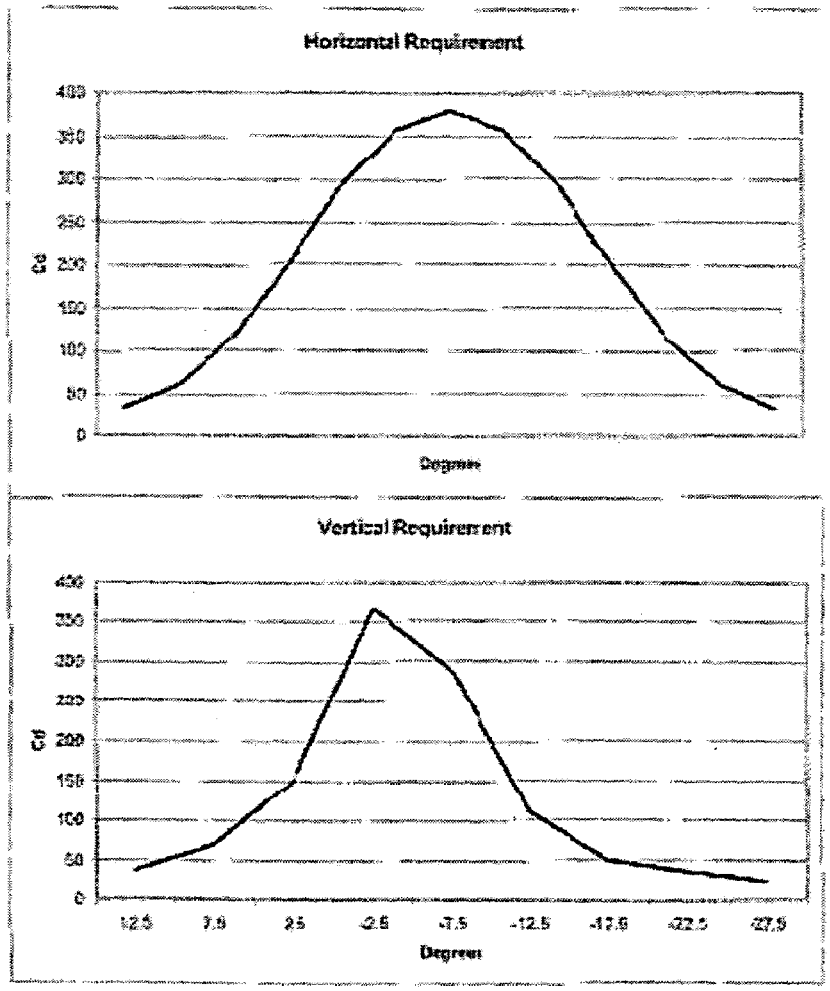
FIG. 7 illustrates exemplary light output patterns through horizontal and vertical axes associated with a spreading or diffusing optical element.
Figure 8:
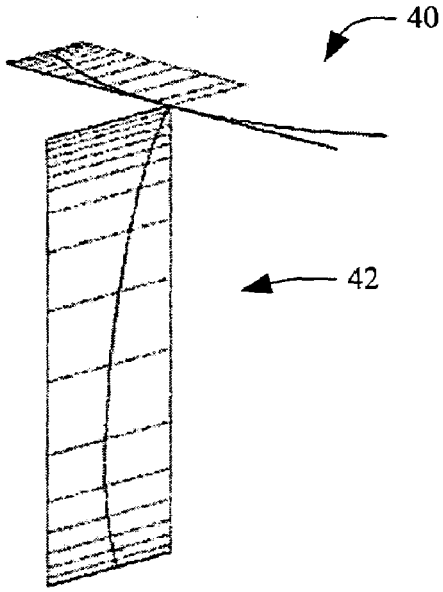
FIG. 8 graphically depicts horizontal and vertical axes of a spreading or diffusing optical element.

FIG. 6 illustrates a non-limiting example of a suitable second optical element 18. The second optical element 18 includes spreading optics 38 that generate a light output pattern that is generally Gaussian shaped through a horizontal axis and relatively non-symmetrical through a vertical axis with a predominance of light below the horizontal axis. FIG. 7 illustrates exemplary light output patterns through the horizontal axis and the vertical axis, and FIG. 8 graphically depicts typical views of horizontal axis at 40 and vertical axis 42 of second optical element 18.

Figure 9:
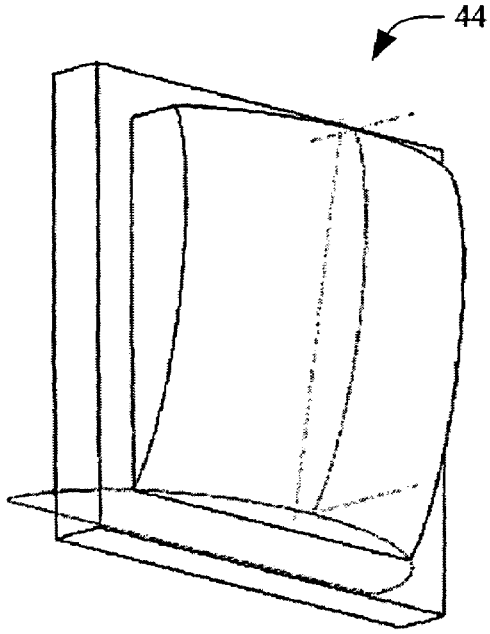
FIG. 9 illustrates an exemplary pillow optic of a spreading or diffusing optical element.

Returning to FIG. 6, suitable spreading optics 38 of the second optical element 18 include, but is not limited to, pillow optics, prism optics, cylindrical optics, etc. Pillow optics are based on a spheroid or a toroid, wherein a square or rectangular portion of the spheroid or toroid is utilized as the optic. FIG. 9 illustrates an exemplary pillow optic 44. Each optic 44 is variously shaped on the horizontal and vertical axes to control the light. The shape of each optic 44 is determined based at least in part on an optical intensity at various positions along the vertical and horizontal axes. One or more, including all of the optics 44 can be similarly and/or differently shaped. Alternatively, a cluster approach can be used. With the cluster approach, smaller optics are positioned between each of the optics 44. Typically, all of the clusters are the same in order to provide a uniform lit appearance regardless of viewing angle.

If one or more LEDs 14 in a cluster becomes non-functional (e.g., Produces less than adequate light), the light output remains substantially lit, provided there is still at least one functioning LED. The cluster also provides a more aesthetically pleasing appearance than a signal with a patterned array of LEDs spread behind the entire face of the lens.

Returning to FIG. 1, typically it is desirable to illuminate substantially The entire optical areas of the first and second optical elements 16 and 18. In order to facilitate such coverage, the first and second optical elements 16 and 18 are suitably positioned at a distance from the LEDs 14 that allows maximum illumination of the cover with a minimum, or preferably no, light lost by illuminating areas other than the optical elements 16 ands 18. In order to mitigate spreading the light beyond the optical areas of the first and second optical elements 16 and 18, an optional lens can be positioned over the LEDs 14 to adjust the light pattern accordingly.

Figure 10:
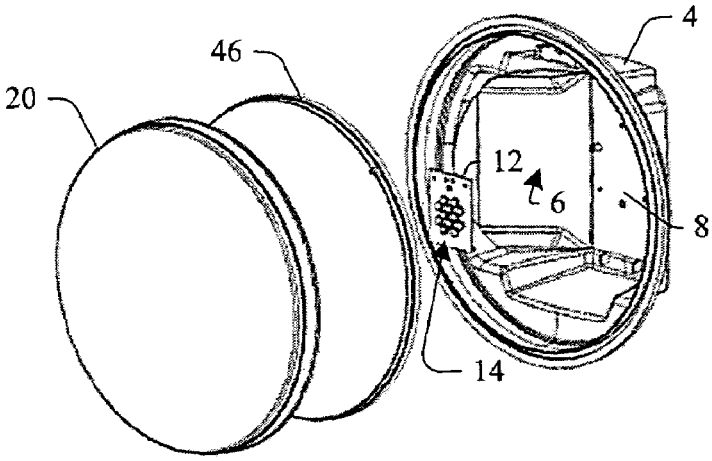
FIG. 10 illustrates an exploded view of a LED signal with a single collimating/diffusing element.

FIG. 10 illustrates an embodiment in which the first and second optical elements 16 and 18 are incorporated into a single optical element 46, which is positioned between the cover 20 and the opening 10. As described above, the one or more LEDs 14 are grouped about a common focal point or central axis perpendicular to the optical element. Both collimation and distribution element are achieved through the single optical element 46.

The invention has been described with reference to the various embodiments. Modifications and alterations may occur to others upon reading and understanding the preceding detailed description. It is intended that the invention be constructed as including all such modifications and alterations insofar as they come within the scope of the appended claims or the equivalents thereof.

The invention claimed is:

1. An LED traffic signal comprising:

a plurality of LEDs arranged on a PCB that emit a light energy, the LEDs are at least two disparate colors;

a lens having a surface that faces toward the plurality of LEDs;

an optical element positioned adjacent to the lens, opposite the plurality of LEDs wherein said optical element includes a collimating surface that collimates light energy emitted by the plurality of LEDs;

a diffuser positioned in direct contact to the optical element, opposite the lens; and a cover positioned in direct contact to the diffuser, opposite the optical element, said cover providing a protective barrier between environmental conditions and said optical element and said diffuser, wherein the lens confines the light energy within the optical areas of the optical element and the diffuser.

2. The LED traffic signal of claim 1, wherein said cover includes at least one of a clear neutral surface, a tint, a color, a texture, and a filter.

3. The LED traffic signal of claim 1, wherein said optical element and said diffuser are distinct components.

4. The LED traffic signal of claim 1, wherein said optical element and said diffuser are the same component.

5. The LED traffic signal of claim 1, wherein said optical element includes a Fresnel lens.

6. The LED traffic signal of claim 5, wherein said Fresnel lens includes a plurality of dioptric rings and a plurality of catadioptric rings, said dioptric rings having a height that is in the range of about 1.5:1 to about 2:1 times greater that a height of the catadioptric rings.

7. The LED traffic signal of claim 6, wherein a transition region, defined as a ratio between a focal length of the optical element and a diameter of a dioptric ring region, is in the range of about 0.5 to about 1.5.

8. The LED traffic signal of claim 1, wherein said diffuser generates a light output pattern that is generally Gaussian shaped through a horizontal axis and relatively non-symmetrical through a vertical axis.

9. The LED traffic signal of claim 1, wherein said diffuser includes one or more of pillow optics, prism optics, and cylindrical optics.

10. The LED traffic signal of claim 9, wherein said pillow optics are based on a cluster approach in which relatively smaller optics are positioned between each of the pillow optics.

11. An LED traffic signal comprising:

a housing defining a volume;

a circuit board having at least one LED, disposed on a surface within the housing, and facing an opening in the housing, wherein the at least one LED emits a light energy;

a lens having a surface that faces toward the at least one LED;

a protective cover in direct contact to the opening in the housing, wherein the protective cover provides a barrier between the volume and an environment;

a spreader in direct contact to the protective cover and adapted to receive collimated light, wherein the spreader generates a light output pattern that is generally Gaussian shaped through a horizontal axis and relatively non-symmetrical through a vertical axis; and a collimator in direct contact to the spreader and adapted to receive light energy emitted by the lens, wherein the lens confines the light energy within the optical areas of the spreader and the collimator;

wherein the at least one LED is arranged on the circuit board so as to approximate a point source of light.

12. The LED traffic signal of claim 11, wherein said circuit board includes a metal core PCB, and further including a heat sink with fins, wherein said heat sink is in thermal contact with said metal core circuit board and facilitates dissipating LED heat.

13. The LED traffic signal of claim 11, wherein said collimator is separated from said spreader by an air gap.

14. The LED traffic signal of claim 11, wherein said collimator and said spreader reside on opposite sides of a single optical element.

15. The LED traffic signal of claim 12, further including a lens positioned within an energy path of the emitted light energy, said lens changes a light pattern of the at least one LED.

16. An LED traffic signal comprising:

a housing comprising:

a cover, and a base, said base having an interior area and an open end;

at least one LED arranged on a metal core PCB, said at least one LED is arranged on the POB so as to approximate a point source of light, wherein the at least one LED emits a light energy;

a lens having a surface that faces toward the at least one LED;

a substantially planar collimating element having a surface facing toward the lens; and a substantially planar diffusing element having a surface facing toward the collimating element, said diffusing element having a plurality of diffusing clusters, the diffusing element is in direct contact with the cover, wherein the lens confines the light energy within the optical areas of the collimating element and the diffusing element, said collimating and said diffusing elements disposed between said cover and said base, and said cover providing a protective barrier between environmental conditions and said collimating element and said diffusing element.

17. The LED traffic signal of claim 16, wherein said LED signal is adapted to be retrofit into an existing traffic light.

18. The LED traffic signal of claim 16, further comprising a sealing means to environmentally seal the at least one LED.

19. The LED traffic signal of claim 16, wherein said collimating element and said diffusing element are individual elements separated from each other by an air gap or said collimating element and said diffusing element are the same element.

* * * * *